US005836188A

United States Patent [19]

Mahan et al.

[11] Patent Number: 5,836,188

[45] Date of Patent: Nov. 17, 1998

[54] METHOD AND APPARATUS FOR BENDING AN ELONGATED MEMBER TO A TARGET ANGLE

[75] Inventors: Clark D. Mahan, Cadillac; Ralph E. Westerburg, Reed City; Alan W. Bass, LeRoy, all of Mich.

[73] Assignee: Pilot Industries, Inc., Dexter, Mich.

[21] Appl. No.: 826,898

[22] Filed: Apr. 9, 1997

[51] Int. Cl.[6] ..... B21B 37/00

[52] U.S. Cl. ..... 72/21.4; 72/217; 72/307; 72/369; 72/702

[58] Field of Search ..... 72/15.1, 21.4, 72/31.04, 31.1, 217, 218, 307, 369, 387, 388, 702; 364/474.07

[56] References Cited

U.S. PATENT DOCUMENTS

| | | | |
|---|---|---|---|
| 4,380,917 | 4/1983 | Uchida et al. | 72/21.4 |
| 4,599,878 | 7/1986 | Hudson et al. | 72/19 |
| 4,802,357 | 2/1989 | Jones | 72/389 |
| 4,959,984 | 10/1990 | Trudell et al. | 72/20 |
| 4,979,385 | 12/1990 | LaFrasse et al. | 72/702 |
| 5,007,264 | 4/1991 | Haack | 72/10 |
| 5,050,089 | 9/1991 | Stelson et al. | 364/474.07 |
| 5,275,031 | 1/1994 | Whiteside et al. | 72/10 |
| 5,461,893 | 10/1995 | Tyler | 72/702 |
| 5,497,647 | 3/1996 | Nagakura | 72/389.3 |
| 5,617,753 | 4/1997 | Glissman et al. | 72/21.3 |
| 5,682,781 | 11/1997 | Schwarze | 72/369 |

*Primary Examiner*—Joseph J. Hail, III
*Assistant Examiner*—Ed Tolan
*Attorney, Agent, or Firm*—Gifford,Krass, Groh, Sprinkle, Patmore, Anderson & Citkowski, P.C.

[57] ABSTRACT

Both a method and apparatus are disclosed for forming a bend in an elongated member, such as a tube, at a predetermined target angle. The elongated member is first bent to an angle equal to the target angle plus a predetermined increment. The elongated member is then returned to the target angle and a value representative of the force necessary to maintain the elongated member at the target angle is inputted into a central processor. This inputted value is then compared with a threshold value and, in the event that the inputted value exceeds the threshold value, the predetermined increment is incremented and the above steps are repeated until the inputted value is less than the threshold value. An apparatus for performing the method of the present invention is also disclosed.

12 Claims, 1 Drawing Sheet

METHOD AND APPARATUS FOR BENDING AN ELONGATED MEMBER TO A TARGET ANGLE

BACKGROUND OF THE INVENTION

I. Field of the Invention

The present invention relates to both a method and apparatus for bending an elongated member, such as a tube, to a target angle between two adjacent sections of the elongated member.

II. Description of the Prior Art

There are many manufacturing situations where it is desirable to bend an elongated member, such as a tube, to a predetermined target angle between two adjacent sections of the elongated member. For example, brake tubing for automotive vehicles typically includes an elongated length of tube having a series of spaced bends in the tube in order to accommodate the vehicle chassis construction. Furthermore, in automotive applications and the like, a harness consisting of several tubes, each having a series of sequential bends, are often secured together in the harness and the entire harness installed as an integral unit in the automotive vehicle.

One problem in forming a series of sequential bends in a bendable material having some resiliency, such as a metal tube, is that the material exhibits spring back from its bent position. For example, in order to bend an elongated copper tube to a 25° angle between two adjacent sections of the tube, it may be necessary to bend the tube to 30° and then allow the tube to spring back to 25°. Furthermore, in many situations, such as the production and manufacture of brake tube harnesses for automotive vehicles, it is necessary that the final or target angle between two adjacent sections of the tubing around the bend be accurately formed in order to ensure that the final assembly will fit in the vehicle as desired.

Even though it is necessary to overbend elongated members, such as metal tubing, in order to achieve the final target bend angle, the actual calculation of the overbend angle has heretofore been difficult, time consuming and inaccurate for a number of different reasons. One such reason is that the required amount of overbend will vary as a factor not only upon the diameter of the tubing or size of the elongated member, but also the wall thickness of the tubing, tubing material and the magnitude of the target bend angle.

SUMMARY OF THE PRESENT INVENTION

The present invention provides both a method and apparatus which overcomes all of the above-mentioned disadvantages of the previously known devices.

In brief, the present invention provides a method for forming a bend at a target angle between adjacent sections of an elongated member, hereinafter referred to as a tube. In the first step, the tube is bent at an intersection of adjacent sections of the tube to an angle equal to the target angle plus a predetermined increment. The tube is then returned to the target angle and held at the target angle by an electric servo motor.

With the tube held at the target angle, the force necessary to maintain the tube at the target angle is then measured. Preferably, the servo motor is utilized to both bend the tube as well as to return the tube to its target angle and hold the tube at the target angle. Consequently, the amount of current required by the servo motor in order to maintain the tube at its target angle is representative of the amount of force necessary to maintain the tube at the target angle.

The value representative of the amount of force necessary to maintain the tube at the target value is then compared with a threshold value. In the event that the value representative of the force exceeds the threshold value, the predetermined increment is itself incremented and the above steps repeated. By incrementing the predetermined increment, the amount of overbend is iteratively increased until the target angle is achieved following spring back, at least within tolerance levels as determined by the threshold value. The amount of overbend, i.e. the target bend, angle plus the final value for the predetermined increment, is then stored in digital memory and utilized to bend subsequent lengths of the tube during a production run.

In the preferred embodiment of the invention, a series of sequential bends are formed in each length of tube. In this case, the amount of overbend required for each of the final or target bends in the elongated tube are sequentially determined by the method of the present invention and then stored in memory and then utilized to form a series of sequential bends in subsequent lengths of the tube.

A machine, preferably using a microprocessor, programmed logic or equivalent, for bending the tube to its target angle is also disclosed.

BRIEF DESCRIPTION OF THE DRAWING

A better understanding of the present invention will be had upon reference to the following detailed description of the preferred embodiment of the present invention, wherein like reference characters refer to like parts throughout the several views, and in which.

DETAILED DESCRIPTION OF A PREFERRED EMBODIMENT OF THE PRESENT INVENTION

Figure 1A:
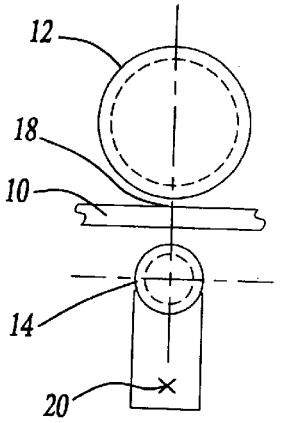
FIGS. 1A–1D are diagrammatic views illustrating the operation of the preferred embodiment of the present invention.

With reference first to FIGS. 1A–1D, in FIG. 1A, an elongated member, such as an elongated metal tube 10, is there shown positioned between two jaws 12 and 14. The jaws 12 and 14, furthermore, are designed so that the portions of the jaws 12 and 14 which engage the elongated member 10 conform to the outer periphery of the elongated member 10. For example, assuming that the elongated member comprises a length of circular tube 10, the jaws 12 and 14 would comprise pulleys which engage around the circular outer surface of the tube 10.

Figure 1B:
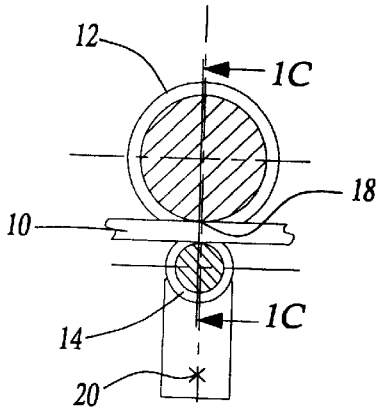
Figure 1C:
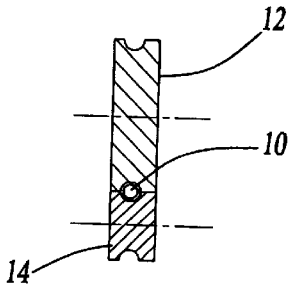

After the tube 10 has been advanced between the jaws 12 and 14 so that the desired site 18 of a target bend is positioned in between the jaws 12 and 14 as shown in FIG. 1A, the jaws 12 and 14 are then moved to their closed position illustrated in FIG. 1B. The jaws 12 and 14 are then rotated about an axis 20 (FIG. 1B) such that a bend is formed in the tube 10 between adjacent sections 22 and 24 of the tube 10. An electric servo motor 26, illustrated diagrammatically in FIG. 1D, is preferably used to rotate the jaws 12 and 14 about the axis 20 and thus bend the tube 10.

As is well known, bendable but slightly resilient materials, such as most metals, exhibit spring back after the material is bent. Thus, in order to achieve a target angle between the adjacent sections 22 and 24 of the tube 10, it is necessary to overbend the tube 10 to the position shown in phantom line in FIG. 1D so that, after spring back, the tube 10 returns to its target angle shown in solid line in FIG. 1D.

Figure 1D:
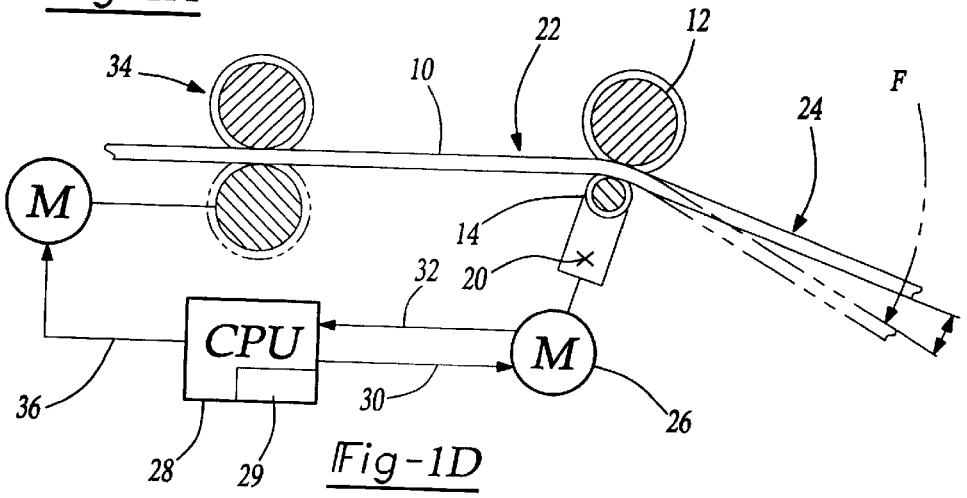

Still referring to FIG. 1D, a control circuit or system 28 preferably including a microprocessor, programmed logic or the like is preferably electrically connected with the servo motor 26. The control system 28 generates output signals on its output line 30 to the servo motor 26 in order to control the activation of the servo motor 26 and thus the angle of the jaws 12 and 14 around the axis 20 during a bending operation of the tube 10. The control system 28 also receives an input signal from the servo motor 26 on line 32 representative of the force necessary to maintain the jaws 12 and 14 at the current rotational position of the jaws 12 and 14. For example, the amount of current required by the servo motor 26 in order to maintain the jaws 12 and 14 at any given rotational angle of the jaws is representative of the amount of force required to hold the tube at that particular angle.

With reference to FIG. 1D, the control system 28 also controls the actuation of a feeder mechanism 34 for the tube 10 by sending appropriate control signals on an output line 36 to the feeder mechanism 34. The feeder mechanism 34, under control of the control system 28, advances the tube 10 until the desired site 18 of the target angle is properly positioned between the jaws 12 and 14.

Figure 2:
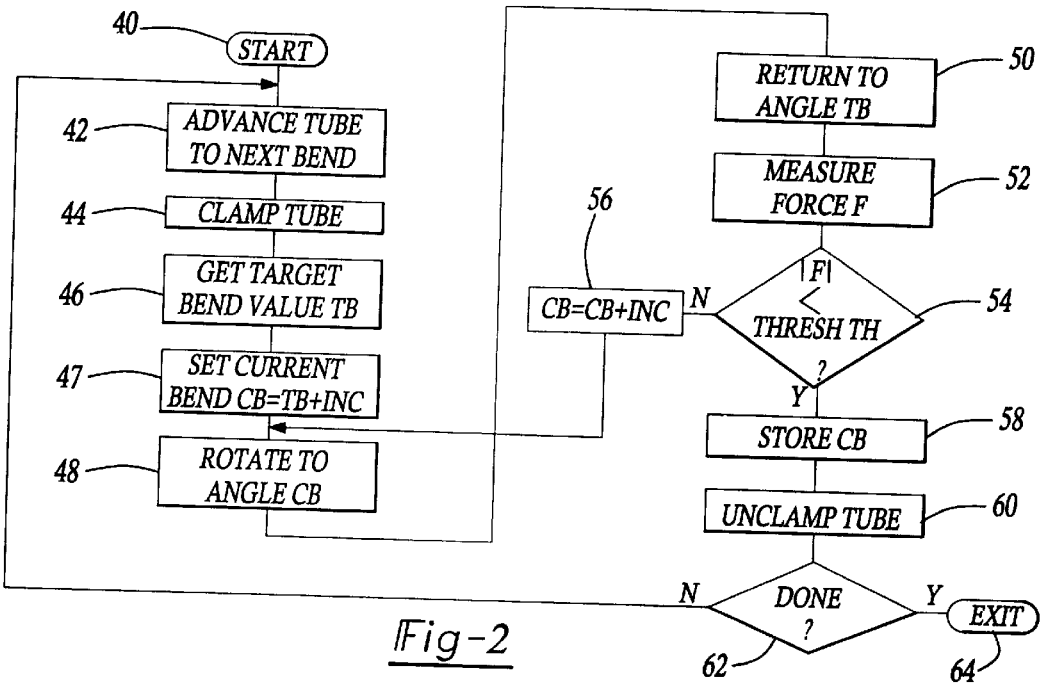
FIG. 2 is a flow chart illustrating the operation of the preferred embodiment of the present invention.

With reference now to FIG. 2, a flow chart illustrating the operation of the present invention is there shown. After initiation of the program at step 40, step 40 branches to step 42 in which the control system 28 (FIG. 1D) activates the feeder mechanism 34 to advance the tube so that the target site 18 for the next bend of the tube 10 is positioned in between the jaws 12 and 14. Step 42 then branches to step 44 where the control system 28, by controlling activation of the servo motor 26, moves the jaws 12 and 14 from their unclamped position (FIG. 1A) to their clamped position (FIG. 1B). Step 44 then branches to step 46.

At step 46, the control circuit 28 obtains the target bend value $T_B$ from appropriate computer memory 29 (FIG. 1D) such as random access memory or persistant memory, e.g. magnetic medium. Step 46 then branches to step 47 where the control system 28 sets the value of a variable for the current bend $C_B$ to the value of the target bend $T_B$ plus a preset increment INC. Step 47 then branches to step 48.

At step 48, the control system 28 generates output signals on its output line 30 to the servo motor 26 to rotate the jaws 12 and 14 to the angle $C_B$. Consequently, for the first rotation of the jaws 12 and 14, the tube 10 is overbent by an amount equal to the preset increment INC. Step 48 then branches to step 50.

At step 50, the control system 28 activates the servo motor 26 to return the tube 10 to the target value $T_B$. In doing so, the control system 28 ensures that the servo motor 26 has sufficient current in order to hold the tube 10 at the target angle $T_B$ despite spring back which may exert a force on the jaws 12 and 14. Step 50 then branches to step 52.

At step 52, the control circuit 28 measures a value F, such as the motor current on line 32, representative of the force necessary for the servo motor 26 to maintain the tube 10 at its target angle $T_B$. For example, if the tube, after spring back, returns exactly to its target angle $T_B$, no force is required by the servo motor 26 to hold the jaws 12 and 14 at the target angle. In this case, the servo motor current would be zero. Conversely, if the spring back would normally return the tube to a position less than the target angle, a certain amount of force, which is proportional to the servo motor current, is required to maintain or hold the tube at the target angle. Step 52 then branches to step 54.

At step 54, the control circuit 28 compares the measured value F representative of the force necessary to maintain the jaws at the target angle $T_B$ with a preset threshold $T_H$. If the measured force F is greater than the threshold value $T_H$, indicative that the tube 10, unless restrained, would spring hack to an angle less than its target angle $T_B$, step 54 branches to step 56. At step 56, the current bend angle $C_B$ is incremented by the predetermined increment INC and step 56 branches back to step 48.

Once step 56 has branched back to step 48, steps 48, 50, 52 and 54 are reiteratively repeated until the measured force F is less than the threshold $T_H$ at which time step 54 branches to step 58. Consequently, the tube 10 is repeatedly bent with each sequential bend increasing the amount of the bend by the preset increment INC. Following each bend, the tube is returned to its target angle and remains at the target angle without spring back, at least within the tolerance levels determined by the threshold value $T_H$.

At step 58, the control system 28 stores the current value for $C_B$ in the memory 29. The current value for the value $C_B$, prior to storage at step 58, has been iteratively incremented at step 56 and represents the total amount of overbend necessary to achieve the final target bend $T_B$ for the tube 10. Step 58 then branches to step 60 in which the control system 28, by activating the servo motor 26, moves the jaws 12 and 14 to their unclamped position (FIG. 1A). Step 60 then branches to step 62.

At step 62, the control system 28 determines whether or not all of the sequential bends in the tube 10 have been performed. If so step 62 branches to step 64 and terminates the program. Conversely, if further sequential bends are required in the tube 10, step 62 branches to step 42 where the above-described process is repeated for each and every sequential bend in the tube 10.

In a typical application, a series of sequential bends is formed in the tube and the amount of overbend required for each sequential bend to achieve the target bend following spring back is stored in the digital memory 29. Thereafter, the control circuit 28 utilizes the values of $C_B$ stored in the digital memory 29 to bend subsequent lengths of tube during a production operation. Thus, the determination of the amount of overbend for each target angle as shown in FIG. 2 represents a teaching cycle wherein the final amount of overbend required for each bend is determined. Following that teaching cycle, the determined values of $C_B$ are then utilized in the production run.

From the foregoing, it can be seen that the present invention provides a highly efficient method for bending elongated members, such as tubes, to at least one and preferably sequential target bends along the length of the elongated member. Having described our invention, however, many modifications thereto will become apparent to those skilled in the art to which it pertains without deviation from the spirit of the invention as defined by the scope of the appended claims.

We claim:

1. A method for forming a bend at a target angle between adjacent sections of an elongated member comprising the steps of:

a) bending said elongated member at an intersection of said adjacent sections to an angle equal to said target angle plus a predetermined increment, b) returning said adjacent sections of said elongated member to said target angle, c) with said adjacent sections of said elongated member at said target angle inputting a value representative of the force necessary to maintain said adjacent sections at said target angle, d) comparing said inputted value with a threshold value, e) increasing said predetermined increment and reiterating steps a) through e) whenever said inputted value exceeds said threshold value.

2. The invention as defined in claim 1 wherein said bending step further comprises the step of bending said elongated member by energizing an electric servo motor mechanically connected with said elongated member.

3. The invention as defined in claim 2 wherein said inputting step comprises the step of measuring electric current of the servo motor.

4. The invention as defined in claim 1 wherein said elongated member comprises a tube.

5. The invention as defined in claim 1 and further comprises the step of storing a final value of said target angle and said predetermined increment.

6. The invention as defined in claim 1 and comprising the steps of sequentially forming a series of bends in said elongated member, each bend having its own target angle, and storing said target angles plus said final predetermined increment for each bend, and thereafter using said stored values to form said series of bends in subsequent lengths of said elongated member.

7. A machine for forming a bend at a target angle between adjacent sections of an elongated member comprising:

a) means for bending said elongated member at an intersection of said adjacent sections to an angle equal to said target angle plus a predetermined increment, b) means for thereafter returning said adjacent sections of said elongated member to said target angle, c) with said adjacent sections of said elongated member at said target angle means for inputting a value representative of the force necessary to maintain said adjacent sections at said target angle, d) means for comparing said inputted value with a threshold value, e) means for increasing said predetermined increment whenever said inputted value exceeds said threshold value and thereafter iteratively reactuating said bending means, said returning means, said inputting means and said comparing means until said inputted value is less than said threshold value.

8. The invention as defined in claim 7 wherein said bending means further comprises an electric servo motor mechanically connected with said elongated member and means for energizing an electric servo motor.

9. The invention as defined in claim 8 wherein said inputting means comprises means for measuring electric current of the servo motor.

10. The invention as defined in claim 7 wherein said elongated member comprises a tube.

11. The invention as defined in claim 7 and further comprising means for storing a final value of said target angle and said predetermined increment.

12. The invention as defined in claim 7 and comprising means for sequentially forming a series of bends in said elongated member, each bend having its own target angle, and means for storing said target angles plus said final predetermined increment for each bend.

* * * * *